United States Patent [19]

Klungle et al.

[11] Patent Number: 4,463,684

[45] Date of Patent: Aug. 7, 1984

[54] HORIZONTAL SHELF UNIT FOR HANDLING PAPERS

[75] Inventors: Mark C. Klungle, Park Township, Ottawa County; Charles A. Haase, Antwerp Township, Van Buren County; Martha J. Winsche, Holland, all of Mich.

[73] Assignee: Haworth, Inc., Holland, Mich.

[21] Appl. No.: 355,643

[22] Filed: Mar. 8, 1982

[51] Int. Cl.[3] ..... A47F 3/14

[52] U.S. Cl. ..... 108/91; D6/478; D6/511; 211/126

[58] Field of Search ..... 108/91, 109, 111; 211/186, 126; D6/186

[56] References Cited

U.S. PATENT DOCUMENTS

| | | | |
|---|---|---|---|
| 254,836 | 3/1882 | Nauerth . | |
| D. 254,887 | 5/1980 | Jorda-Segui | D6/186 |
| 754,816 | 3/1904 | Schriefer | 108/109 |
| 1,355,486 | 10/1920 | Longenecker . | |
| 1,890,143 | 12/1930 | Bales . | |
| 3,549,018 | 12/1970 | Wilson | 211/126 |
| 3,730,605 | 5/1973 | Eckard . | |
| 3,788,241 | 1/1974 | Ravreby | 108/111 X |
| 3,908,831 | 9/1975 | Brendgord | 211/126 X |
| 4,023,691 | 5/1977 | Perel | 211/126 X |
| 4,049,126 | 9/1977 | Halverson | 211/104 |
| 4,074,810 | 2/1978 | Juergens et al. . | |
| 4,236,460 | 12/1980 | Poupko | 108/111 X |
| 4,236,768 | 12/1980 | Morrone . | |

OTHER PUBLICATIONS

"Kwik File", brochure, 1978.

"Westinghouse ASD Paper Management Systems", brochure.

"Westinghouse ASD Group Inner Cabinet Storage System", brochure.

*Primary Examiner*—William E. Lyddane

*Assistant Examiner*—Peter A. Aschenbrenner

*Attorney, Agent, or Firm*—Flynn, Thiel, Boutell & Tanis

[57] ABSTRACT

A shelf unit includes a U-shaped frame having a pair of spaced legs connected by a bight. The frame comprises first and second L-shaped members, having cooperable coupling structures provided at the ends thereof for rigidly and releasably interconnecting the members together. The cooperating coupling structures prevent movement of the L-shaped members relative to each other, except angular movement between a use position in which the legs of the frame are substantially parallel and an assembly position in which the outer ends of the legs are adjacent each other. The members can be separated in the assembly position to disengage the coupling structures. A plurality of vertically spaced horizontal grooves are provided on the inner surfaces of the frame, and a planar shelf can be slidably received in each groove when the L-shaped members are in the use position, thereby preventing the legs of the frame from moving toward each other. The coupling structures each include a flange and a recess on one L-shaped member respectively cooperable with a recess and flange on the other member.

14 Claims, 15 Drawing Figures

HORIZONTAL SHELF UNIT FOR HANDLING PAPERS

FIELD OF THE INVENTION

This invention relates to a shelving device and, more particularly, to a shelf unit having a plurality of vertically spaced shelves for handling and storing papers.

BACKGROUND OF THE INVENTION

Modern business techniques have given rise to an increasing variety of shapes, weights and sizes of papers which must be efficiently handled and stored. A number of shelf devices have been developed to facilitate accessible short and long-term storage of paper. While these devices have generally been acceptable for their intended purposes, they have not been satisfactory in all respects. For example, these devices often consist of two spaced sides with a plurality of horizontal shelves supported therebetween, a three-sided frame supporting a plurality of shelves with the sides being connected at the corners of the frame, or a plurality of single shelf units which are vertically stacked on top of each other. These devices generally lack structural rigidity and thus tend to wobble. Further, they are frequently made from metal, and thus may have sharp edges that injure users and tear papers.

In addition, the assembly of these known devices often requires a number of miscellaneous parts such as threaded fasteners, and often requires the use of tools. Also, the interconnecting media, such as the threaded fasteners, are often visible on the assembled device, thereby detracting from the aesthetic appeal of the device.

Moreover, it is frequently impossible or very expensive to adjust the width of the device to accommodate a different paper size, either because there is no provision for width adjustment or because the width adjustment requires a time consuming disassembly and reassembly of the device which may, as mentioned above, require the use of tools.

Accordingly, it is an object of the present invention to provide a shelf unit for handling papers which has a frame comprising two or more members which can be securely and rigidly interlocked. The manner of interconnecting the members is simple and quick, does not require the use of tools, and is obvious to the end user.

A further object is to provide a shelf unit, as aforesaid, in which the structure for interconnecting the frame members is completely integral with such members so that the shelf unit has fewer parts than known devices.

Still a further object is to provide a shelf unit, as aforesaid, in which the structure interconnecting the frame members is entirely concealed from view when the frame is assembled.

Another object is to provide a shelf unit, as aforesaid, which can easily and quickly be adjusted in width to accommodate various standard paper sizes.

Still another object is to provide a shelf unit, as aforesaid, which can be utilized as a free standing unit on a horizontal surface, can be suspended through the use of a relatively simple bracket, or can be stacked in a stable manner on or between similar units without physical interconnection thereof.

It is also an object to provide a shelf unit, as aforesaid, which is aesthetically attractive, is relatively inexpensive to manufacture, and is very durable.

SUMMARY OF THE INVENTION

The objects and purposes of the invention, including those set forth above, are met by providing a shelving unit which includes a U-shaped frame having a pair of spaced parallel legs connected by a bight. The frame includes first and second members and also includes a coupling structure for releasably and rigidly interconnecting the first and second members in a shelf-supporting or use position. When in this position, the coupling structure will permit the legs of the frame to move toward each other to effect separation of the members. At least one shelf is removably supported between the legs of the frame, and the shelf resists movement of the legs toward each other to maintain the members rigidly connected together.

In the preferred embodiment, the first and second members each have first and second arms arranged in substantially an L-shape, the first arm of each member defining a respective leg of the frame and the second arm defining a portion of the bight of the frame. The coupling structure includes a first coupling part integral with the outer end of the second arm of the first member and a second coupling part integral with the outer end of the second arm of the second member. The first and second coupling parts, when engaged, effect a rigid but releasable interconnection of the frame members. Alternatively, an optional spacer member is provided which has third and fourth coupling parts integral therewith at opposite ends thereof, and the spacer member can be rigidly coupled between the second arms of the L-shaped members, thereby simultaneously increasing the length of the bight of the frame and effecting the releasable interconnection of the L-shaped members.

A plurality of spaced, parallel grooves are preferably provided in the inwardly facing surfaces of the legs and bight of the frame, and each shelf has edges which are slidably received in a respective groove.

In the preferred embodiment, the coupling structure includes a flange and a recess provided at the outer end of the second arm of each L-shaped member. The flange and recess on the first L-shaped member are respectively cooperable with the recess and flange on the second L-shaped member. The arrangement of the coupling structure is such that each flange is fully received within the corresponding recess and the coupling structure is entirely concealed from view when the L-shaped members are releasably interconnected.

Figure 1:
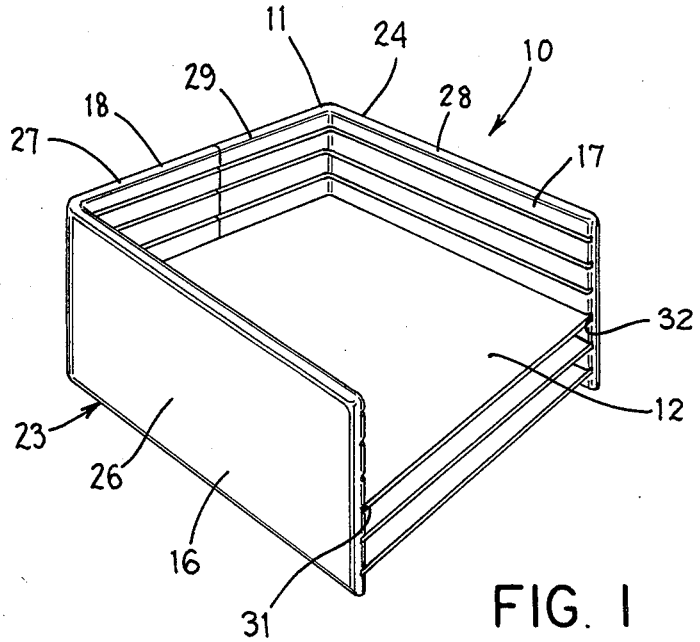
FIG. 1 is a perspective view of a shelf unit embodying the present invention.

Certain terminology will be used in the following description for convenience in reference only and will not be limiting. The words "up" and "down" will designate directions in the drawings to which reference is made. The words "in" and "out" will respectively refer to directions toward and away from the geometric center of the shelf unit and designated parts thereof. Such terminology will include the words specifically mentioned, derivatives thereof and words of similar import.

DETAILED DESCRIPTION

Figure 3:
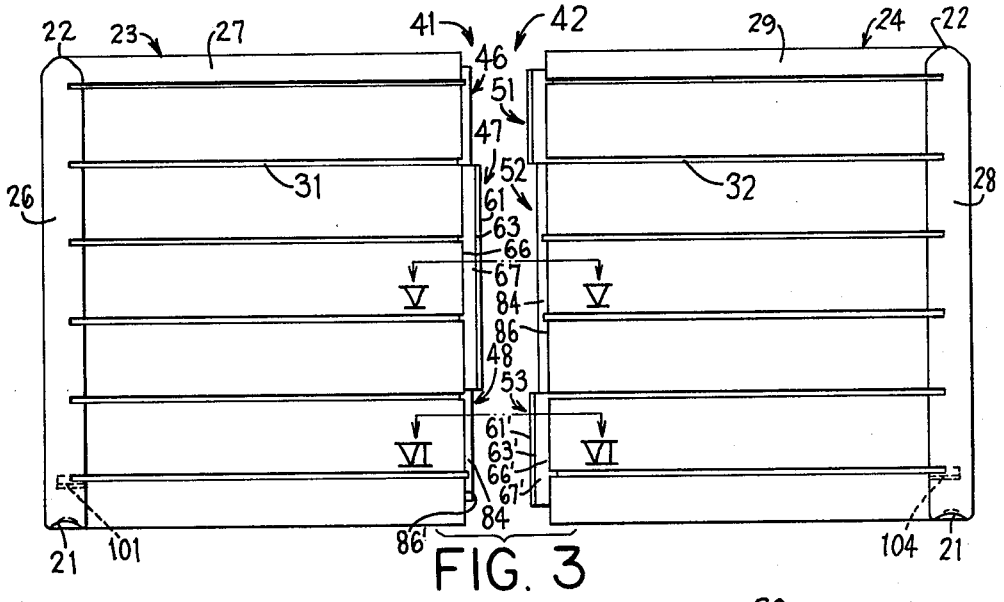
FIG. 3 is a front view of two L-shaped members which are components of the frame of FIG. 2, which members are spaced apart for purposes of illustration.
Figure 4:
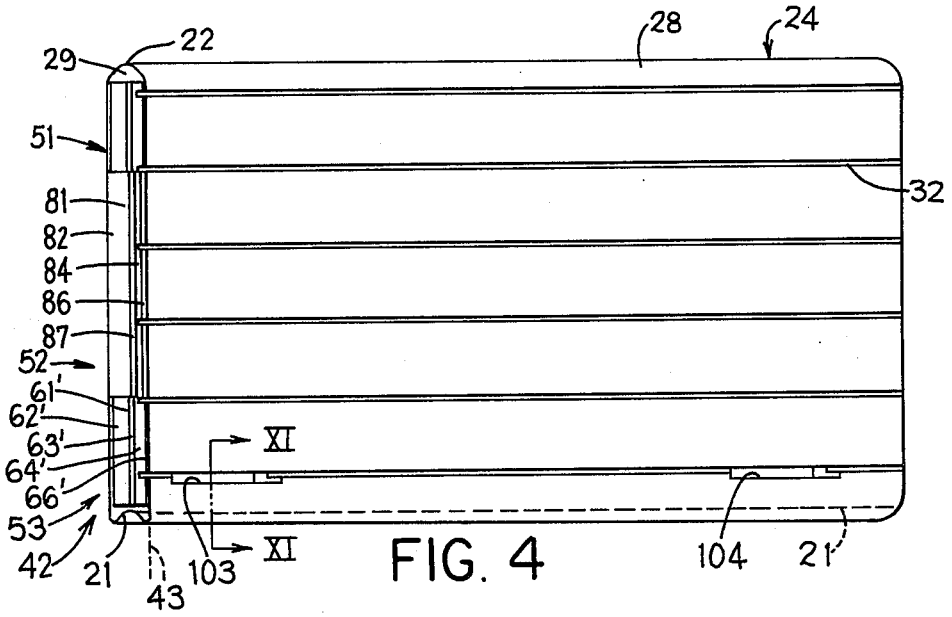
FIG. 4 is an inner side view of the rightward L-shaped member of FIG. 3.

Referring to FIG. 1, a shelf unit 10 includes a U-shaped frame 11 and a plurality, here three, of planar shelves 12 which are supported on the frame 11 in a manner described hereinafter. The U-shaped frame 11 has two spaced, planar and parallel legs 16 and 17 which are connected by a planar bight 18. As shown in FIGS. 3 and 4, a concave groove 21 is provided in the bottom edge of the frame, whereas the top edge is convex, thereby defining an upwardly projecting rounded ridge 22. In certain applications, two or more of the U-shaped frames 11 can be vertically stacked, the convex top edge 22 of each frame 11 except the uppermost one being received in the concave groove 21 of the frame 11 thereabove to restrict relative lateral movement therebetween.

Figure 2:
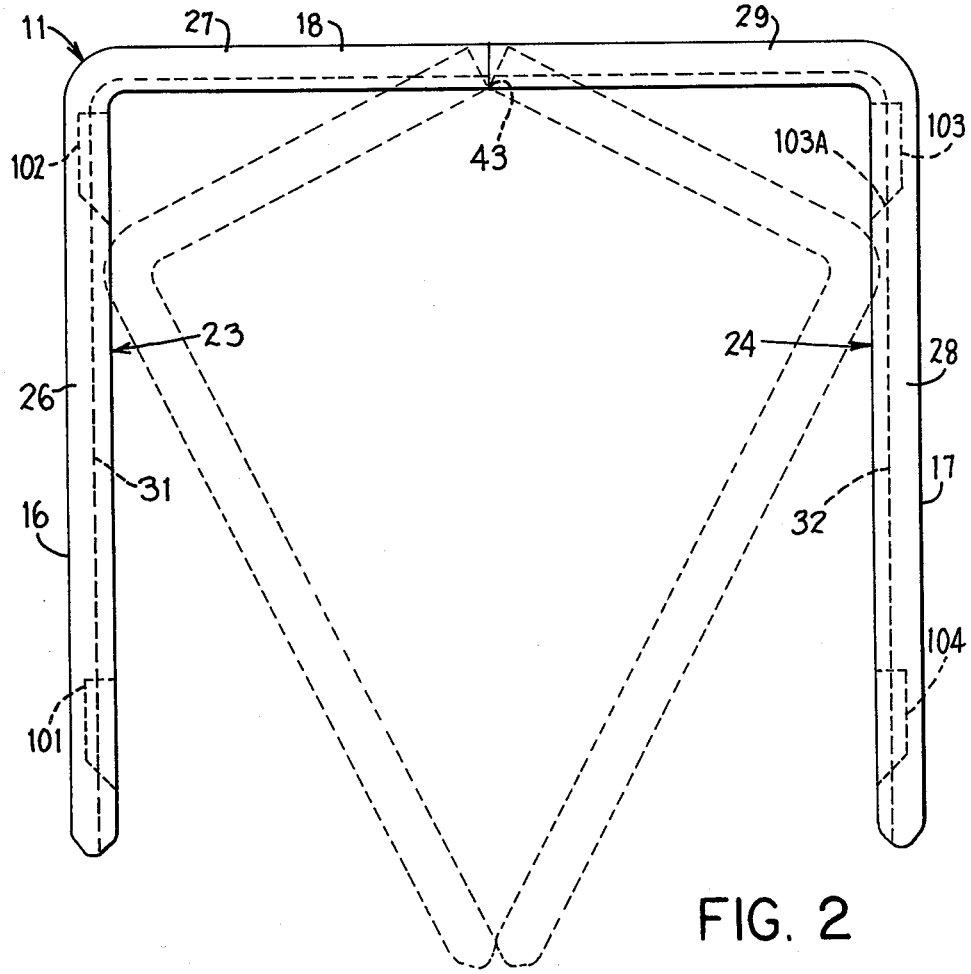
FIG. 2 is a top view of a U-shaped frame which is a component of the shelf unit of FIG. 1.
Figure 11:
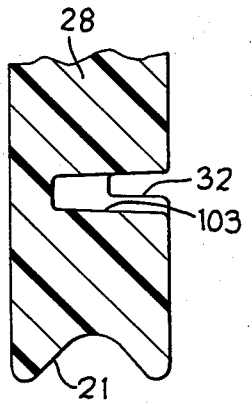
FIG. 11 is an enlarged, fragmentary sectional view taken along the line XI—XI of FIG. 4.

As best shown in FIGS. 2 and 3, the U-shaped frame 11 includes two similar L-shaped members 23 and 24. The L-shaped member 23 has two vertical, planar arms 26 and 27 which are normal to each other, and the L-shaped member 24 has two vertical, planar arms 28 and 29 which are also normal to each other. When the ends of the arms 27 and 29 of the L-shaped members 23 and 24 are releasably interconnected in a manner described hereinafter, the arms 26 and 28 respectively define the legs 16 and 17 of the frame 11, and the arms 27 and 29 are coplanar and define the bight 18 of the frame 11.

The L-shaped member 23 has plural, here six, vertically spaced horizontal grooves 31 provided in the inwardly facing surfaces of the arms 26 and 27 thereof. Similarly, the L-shaped member 24 has an equal number of vertically spaced grooves 32 provided in the inwardly facing surfaces of the arms 28 and 29 thereof. When the L-shaped members 23 and 24 are releasably interconnected, the grooves 31 and 32 are aligned and lie in common horizontal planes.

Referring to FIG. 3, the L-shaped members 23 and 24 have respective coupling structures 41 and 42 integrally provided at the ends of the arms 27 and 29 thereof. The coupling structures 41 and 42 can be engaged and disengaged by relative rotation of the members 23 and 24 about a vertical axis 43 (FIG. 2) in order to effect the releasable interconnection of the members 23 and 24. When engaged, the coupling structures 41 and 42 prevent all relative movement of the members 23 and 24 except relative rotation about the axis 43 between a use position illustrated in solid lines in FIG. 2 and an assembly position illustrated in broken lines in FIG. 2. In the assembly position, the coupling structures 41 and 42 are disengaged and the members 23 and 24 can be separated by moving the ends of the arms 27 and 29 apart.

The coupling structure 41 includes upper, central, and lower coupling parts 46, 47 and 48 respectively, and the coupling structure 42 similarly includes upper, central, and lower coupling parts 51, 52 and 53 respectively. The upper and lower coupling parts 46 and 48 of the coupling structure 41 are identical in horizontal cross section, as are the upper and lower coupling parts 51 and 53 of the coupling structure 42. Accordingly, only coupling parts 47, 48, 52 and 53 are described in detail.

Figure 5:
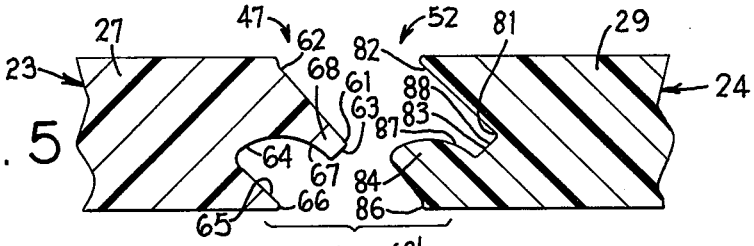
FIG. 5 is an enlarged fragmentary sectional view taken along the line V—V of FIG. 3.

Referring to FIG. 5, the central coupling part 47 includes a substantially V-shaped projection 61 defined by planar surfaces 62 and 63 provided on the outer end of the arm 27 of the L-shaped member 23. The surfaces 62 and 63 are substantially normal to each other. A sector-shaped recess 64 having a central angle of approximately 90° is provided in the planar surface 63, the axis of the recess 64 being substantially coincident with an outer edge 66 of the projection 61. The planar surface 62 faces substantially away from the edge 66 of the projection 61, and an arcuate surface 67 of the recess 64 faces toward the edge 66 of the projection 61. In effect, therefore, the central coupling part 47 includes a flange 68 having the planar surface 62 on one side thereof and the arcuate surface 67 on the other side thereof. The surface 62 is approximately parallel with the planar surface 65 defined by the recess 64.

The lower coupling part 53 (FIG. 6) of the coupling structure 42 is substantially a mirror image of the central coupling part 47 just described, and hence the corresponding components are identified by the same reference numerals with the addition of a prime (') thereto.

The central coupling part 52 (FIG. 5) of the coupling structure 42 includes a V-shaped groove 81 defined by two substantially planar surfaces 82 and 83 provided at the outer end of the arm 29 of the L-shaped member 24. The surfaces 82 and 83 are substantially normal to each other. A sector-shaped projection having a central angle of approximately 90° and a radius slightly greater than that of the recess 64 is provided in the planar surface 83, the axis of the projection 84 being substantially coincident with an outer edge 86 of the groove 81. The planar surface 82 faces substantially toward the edge 86 of the groove 81, and an arcuate surface 87 on the projection 84 faces away from the edge 86. In effect, a recess 88 is defined which has the planar surface 82 on one surface thereof and the arcuate surface 87 on the opposite side thereof.

The lower coupling part 48 (FIG. 6) of the coupling structure 41 is substantially a mirror image of the coupling part 53 just described, and hence is also identified by the same reference numerals but with a prime (') added thereto.

The vertical lengths of the flanges 68 and 68' are respectively substantially equal to the vertical lengths of the recesses 88 and 88'.

Referring to FIG. 2, two spaced recesses 101 and 102 of generally trapezoidal shape are provided in the leg 16 of the frame 11. Two similar recesses 103 and 104 are provided in the leg 17 of the frame 11. The recesses 101–104 are substantially identical to each other, and therefore only recess 103 will be described in detail.

Referring to FIGS. 3 and 4, the recess 103 is aligned vertically with the lowermost groove 32 in the L-shaped member 24, but has a vertical dimension slightly greater than that of the groove 32 and extends slightly below the groove 32. The recess 103 is also slightly deeper than the groove 32. The recess 103 has a vertical surface 103A at the forward end thereof which is angled at approximately 45° with respect to the plane of the arm 28 of the L-shaped member 24.

Figure 13:
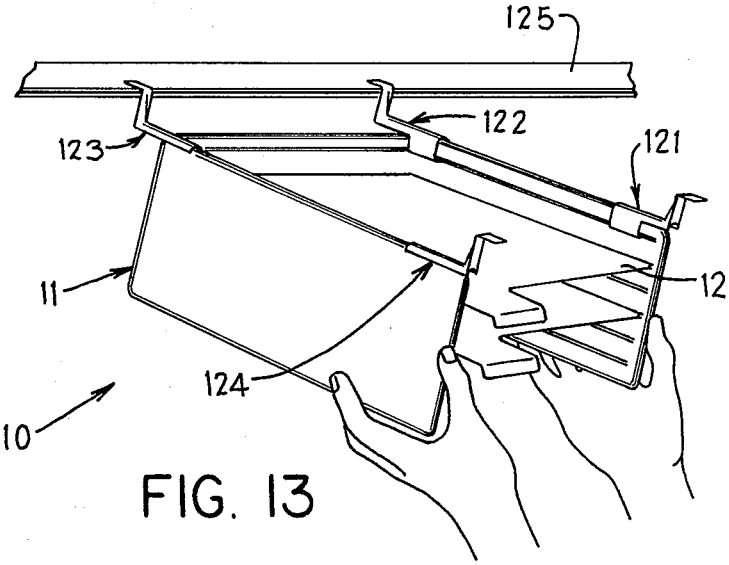
FIG. 13 is a perspective view of the shelf unit of FIG. 1 illustrating optional brackets adapted to suspend the shelf unit from a frame.
Figure 14:
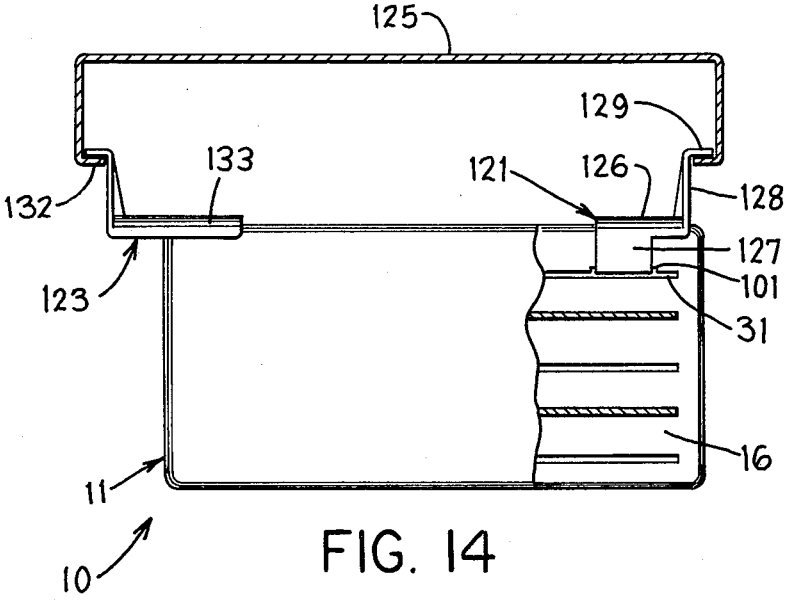
FIG. 14 is a fragmentary side view of the shelf unit, brackets and frame of FIG. 13.

As illustrated in FIGS. 13 and 14, the shelf unit 10 can be inverted and suspended below a support frame 125 by means of brackets 121–124 which respectively engage the recesses 101–104.

Figure 15:
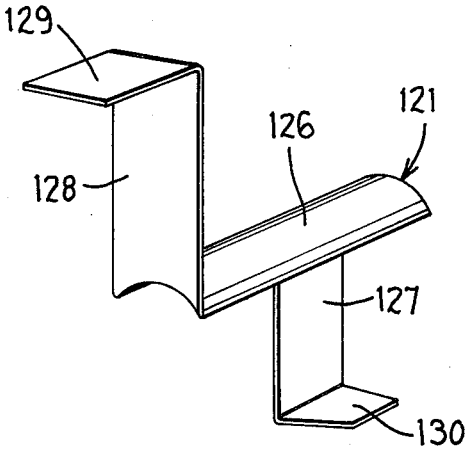
FIG. 15 is a perspective view of one of the brackets of FIG. 13.

The bracket 121, as illustrated in FIGS. 14 and 15, includes an elongate plate 126 of arcuate cross section which extends along the upper edge of the frame 11. A planar arm 127 extends downwardly from the inner end of plate 126 to the recess 101 and has a perpendicular flange 130 at the lower end thereof which extends into the recess 101 and preferably has a trapezoidal shape corresponding to the shape of the recess 101. The lower end of the arm 127 and the flange thereon preferably do not extend downwardly past the recess 101, so as to facilitate insertion and removal of a shelf in the slot 31 adjacent the recess 101. An arm 128 extends upwardly from the outer end of the arcuate plate 126 and has a tab 129 at the upper end thereof which is generally perpendicular thereto.

The rear bracket 123 is substantially identical to the front bracket 121, except that the arcuate plate 133 thereof is slightly longer than the arcuate plate 126 of the bracket 121. The brackets 124 and 122 are mirror images of the brackets 121 and 123, respectively. The brackets 122, 123 and 124 are therefore not described in greater detail.

The brackets 121–124 are preferably made from either metal or plastic and are slightly flexible to facilitate their attachment and removal from the shelf unit 10.

Referring to FIG. 14, the frame 125 has two spaced, parallel and generally horizontal flanges 131 and 132. The tabs at the upper ends of the front brackets 121 and 124 each rest on the flange 131, and the tabs at the upper ends of the rear brackets 122 and 123 each rest on the flange 132, thereby effecting the suspension of the shelf unit 10 from the frame 125. The upper arms of the brackets are appropriately resiliently deflected so as to permit mounting of the unit on the frame.

Figure 12:
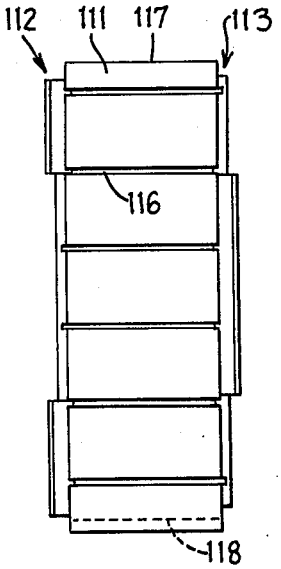
FIG. 12 is a front view of a spacer member which can be incorporated into the frame of FIG. 2.

Referring to FIG. 12, an optional spacer member 111 is substantially planar and vertical and has coupling structures 112 and 113 integrally provided at opposite ends thereof. The coupling structure 112 is substantially identical to the coupling structure 42 (FIG. 3) and the coupling structure 113 is substantially identical to the coupling structure 41. The coupling structures 112 and 113 are therefore not described in detail.

The spacer member 111 has a plurality, here six, of vertically spaced, horizontal grooves 116 in the front surface thereof. The top edge 117 of the spacer member 111 is preferably rounded, and the bottom edge of the spacer member 111 preferably has a downwardly facing concave groove 118 extending therealong.

In the preferred embodiment, the L-shaped members 23 and 24 and the spacer member 111 are preferably each an integral molded plastic part. The shelves 12 are preferably metal.

ASSEMBLY

Figure 6:
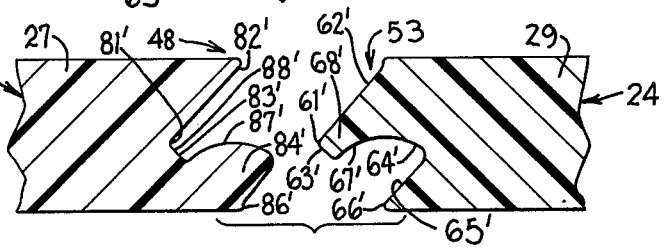
FIG. 6 is an enlarged, fragmentary sectional view taken along the line VI—VI of FIG. 3.
Figure 7:
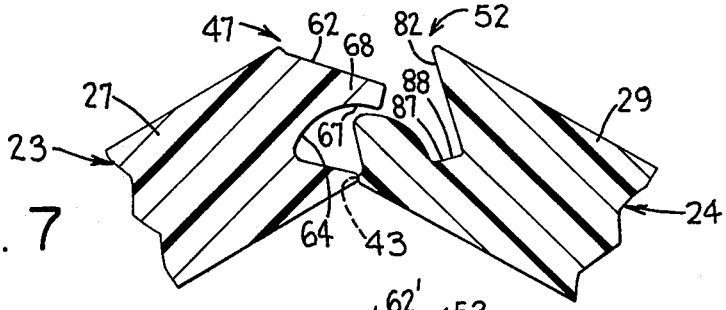
FIGS. 7 and 8 are sectional views similar to FIGS. 5 and 6, respectively, but showing the components in a different positional relationship.
Figure 8:
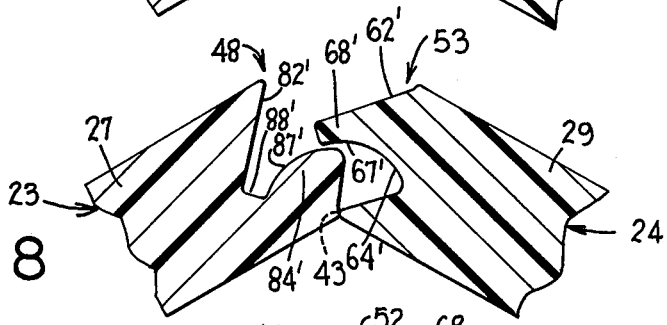

The shelf unit 10 is assembled in the following manner. First, the L-shaped members 23 and 24 are positioned as shown by dotted lines in FIG. 2. In this assembly position, the arms 27 and 29 are disposed as shown in FIGS. 5 and 6 so that edges 66 and 66' of the V-shaped projections 61 and 61' respectively engage the edges 86 and 86' of the V-shaped grooves 81 and 81'. The axes of the sector-shaped recesses 64 and 64' and the sector-shaped projections 84 and 84' are thus all substantially coincident with each other and with the pivot axis 43. The arms 27 and 29 form an angle of roughly 135° with respect to each other, and the outer ends of the arms 26 and 28 are relatively close to each other.

Figure 9:
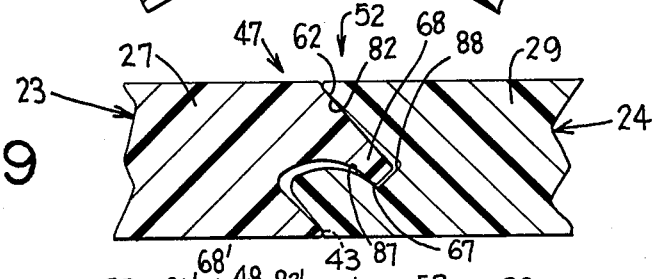
FIGS. 9 and 10 are sectional views similar to FIGS. 5 and 6, respectively, but showing the components in a further positional relationship.
Figure 10:
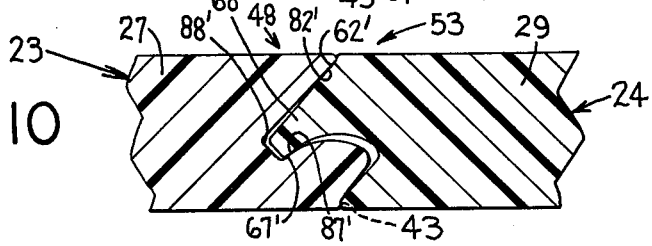

The L-shaped members 23 and 24 are then pivoted relative to each other about the axis 43 so that the outer ends of the arms 26 and 28 move away from each other until the surfaces 62 and 82 engage and the surfaces 62' and 82' engage, thereby preventing further rotation. In this shelf-supporting or use position, the arms 26 and 28 are substantially parallel to each other (as illustrated in FIG. 2), the arms 27 and 29 are coplanar, and the coupling structures 41 and 42 (FIG. 3) releasably interconnect the L-shaped members 23 and 24 (as illustrated in FIGS. 9 and 10).

When the L-shaped members 23 and 24 have been thus interlocked, the flanges 68 and 68' extend in directions which are substantially normal to each other, and the surfaces 62 and 62' thereon are thus oriented substantially normal to each other, as are the surfaces 82 and 82' which respectively engage and are substantially parallel to the surfaces 62 and 62'. Due to the fact that the radii of the recesses 64 and 64' are slightly greater than the respective radii of the projections 84 and 84', only a portion of the respective arcuate surfaces 67 and 67' on the flanges 68 and 68' are in engagement with the arcuate surfaces 87 and 87'. The engaged portions of surfaces 67 and 67' respectively face in substantially the same directions as the surfaces 82 and 82', which directions are substantially normal. As a result of the relative orientations just described, the surfaces of the arms 23 and 24 engaged along the axis 43 and the respective pairs of engaging surfaces 62 and 82, 62' and 82', 67 and 87, and 67' and 87' effectively prevent relative linear movement of the arms 23 and 24 with respect to each other in directions perpendicular to the axis 43. In addition, the fact that the vertical lengths of the flanges 68 and 68' are substantially identical to the respective vertical lengths of the recesses 88 and 88' prevents movement in a direction parallel to the axis 43. In short, the L-shaped members 23 and 24 are rigidly interconnected in the use position and relative movement therebetween is not possible in any direction, except that relative rotation is possible about the axis 43 in a direction which moves the tips of the arms 26 and 28 inwardly toward each other. As evident from FIGS. 1, 2, 9 and 10, the coupling parts 46–48 and 51–53 are completely concealed in the use position. Further, a stable frame is provided by interlocking only two members 23 and 24 using only the coupling structures 41 and 42 which are integral therewith. No additional parts such as pins or screws are required.

Once the L-shaped members 23 and 24 have been securely interlocked in the manner described above to produce the U-shaped frame 11, one or more of shelves 12 are slidably inserted into the slots 31–32. As discussed above, the only possible relative movement between the L-shaped members 23 and 24 when in the use position is rotational movement about the axis 43 which causes the arms 26 and 28 to move toward each other, but once one or more of the shelves 12 have been inserted therebetween, this movement is also prevented. Accordingly, the assembled shelf unit 10 is a rigid and stable device. Two or more of the shelf units 10 can be vertically stacked in a stable manner, the convex top edge 22 and concave bottom edge 21 of adjacent units 10 being cooperable to limit relative lateral movement.

The optional brackets 121–124 are mounted on the shelf unit 10 by inserting the respective flanges thereon into the respective recesses 101–104 and then flexing each bracket slightly to snap the arcuate plate thereof over the edge of the frame 11.

The shelf unit 10 can be disassembled by performing the sequence of steps just described in a reverse order.

The shelf unit 10 can also be assembled using the optional spacer member 111 of FIG. 12 in order to increase the length of the bight 18 of the U-shaped frame 11 and thereby adapt the frame 11 for use with a larger size of paper. This is done by placing the spacer member 111 between the outer ends of the legs 27 and 29 of the L-shaped members 23 and 24 and effecting engagement of the coupling structures 41 and 112 and the coupling structures 42 and 113 in substantially the same manner as described above for effecting engagement of the coupling structures 41 and 42. The grooves 116 vertically align with the grooves 31 and 32. The legs 16 and 17 of the frame 11 will still be parallel to each other, but will be further spaced by a distance equal to the width of the spacer member 111. Shelves can then be inserted into the grooves in the U-shaped frame 11, which shelves are substantially identical to the shelves 12 of FIG. 1 but are wider by an amount equal to the width of the spacer member 111.

Although preferred embodiments of the invention have been disclosed in detail for illustrative purposes, it will be recognized that variations or modifications of the disclosed apparatus, including the rearrangement of parts, lie within the scope of the present application.

The embodiments of the invention in which an exclusive property or privilege is claimed are defined as follows:

1. A shelving unit, comprising:

a U-shaped frame having a pair of spaced parallel legs connected by a bight, each said leg having a free end which is remote from said bight, said frame including first and second members, each said leg of said frame being provided on a respective one of said first and second members, and including coupling means releasably interconnecting said first and second members to prevent relative movement therebetween other than in a direction which causes said free ends of said legs to relatively pivotally move toward each other;

at least one shelf removably supported between said legs for resisting movement of said legs toward each other so as to maintain said frame in a rigid U-shaped configuration;

support frame means; and means cooperable with said U-shaped frame and said support frame means for suspending said U-shaped frame from said support frame means, including means defining a recess near each end of each said leg of said U-shaped frame and including a bracket adjacent each said recess;

each said bracket being flexible and including an arcuate plate extending along the upper edge of the associated leg of said frame, an arm fixed on said plate which extends to the associated recess and has a flange thereon which extends into such recess, and an arm fixed on said plate which extends away from said frame and has a tab on the outer end thereof which is generally perpendicular thereto and engages said support frame means.

2. A shelving unit, comprising:

first and second L-shaped members, each having substantially perpendicular first and second arms which each have a free end remote from the intersection of said first and second arms;

first and second coupling means respectively provided on said free ends of said first arms of said first and second members and cooperable with each other for releasably interconnecting said members, said first and second coupling means, when engaged, permitting relative pivotal movement of said members about a pivot axis within a range limited by a use position in which said second arms are spaced and substantially parallel and an assembly position in which said second arms are nonparallel and said free ends thereof are adjacent, said first and second coupling means being uncoupled when said members are in said assembly position and, when said members are in said use position, preventing all relative movement between said members other than relative pivotal movement toward said assembly position; and at least one shelf removably supported between said second arms when said members are in said use position, said shelf resisting movement of said members toward said assembly position and thereby maintaining said members in a rigid, U-shaped configuration.

3. The shelving unit of claim 2, wherein said first and second coupling means are concealed from view when said first and second members are interconnected.

4. The shelving unit of claim 2, including a planar spacer member adapted to be placed between said free ends of said first arms of said first and second members, said spacer member having third and fourth coupling means integrally provided on opposite edges thereof, said first coupling means being cooperable with said third coupling means and said second coupling means being cooperable with said fourth coupling means for releasably interconnecting said first and second members to said spacer member.

5. The shelving unit of claim 2, wherein said shelf is substantially planar, and wherein said legs have grooves provided in the inwardly facing surfaces thereof for slidably receiving the edges of said shelf therein.

6. The shelving unit of claim 2, wherein said first and second members each have a top edge and a bottom edge, wherein one of said top and bottom edges of said first and second members has a groove extending therealong, and wherein the other of said top and bottom edges of each of said first and second members has a ridge extending therealong for permitting vertical stacking of at least two said shelving units.

7. The shelving unit of claim 2, wherein said first and second members form a substantially U-shaped frame when in said use position, and including support frame means and bracket means adapted to be releasably mounted on said U-shaped frame and cooperable with said support frame means for suspending said U-shaped frame from said support frame means.

8. The shelving unit of claim 7, wherein said U-shaped frame includes means defining a bracket recess near each end of each said leg of said U-shaped frame, and wherein said bracket means includes four brackets, each said bracket being adjacent a respective said bracket recess, wherein each said bracket is flexible and includes an arcuate plate extending along the upper edge of the associated leg of said frame, an arm fixed on said plate which extends to and has a flange thereon which extends into said associated bracket recess, and an arm fixed on said plate which extends away from said frame and has a tab on the outer end thereof which is generally perpendicular thereto and engages said support frame means.

9. The shelving unit of claim 2, wherein said first and second coupling means include said first and second members each having at said free end of said first arm thereof a generally V-shaped groove and a sector-shaped projection on a surface of said V-shaped groove, said surface of each said V-shaped groove having an outer edge which is substantially coincident with said pivot axis and each said sector-shaped projection having an axis which is substantially coincident with said pivot axis, wherein said first and second coupling means further include said first and second members each having at said free end of said first arm thereof and spaced axially from said V-shaped groove therein a generally V-shaped projection and a sector-shaped recess in a surface of said V-shaped projection, said surface of each said V-shaped projection having an outer edge which is substantially coincident with said pivot axis and each said sector-shaped recess having an axis which is substantially coincident with said pivot axis, and wherein when said first and second members are in said use position, said V-shaped projection on each of said first and second members is received in said V-shaped groove in the other of said first and second members, said sector-shaped recess in each said V-shaped projection receiving said sector-shaped projection in the corresponding V-shaped groove.

10. The shelving unit of claim 9, wherein each said V-shaped projection and the associated V-shaped groove have substantially equal lengths in a direction parallel to said pivot axis.

11. The shelving unit of claim 10, wherein each said sector-shaped projection and each said sector-shaped recess has a central angle which is approximately 90°.

12. The shelving unit of claim 2, wherein said first and second coupling means are integral portions of said first and second members, respectively.

13. The shelving unit of claim 2, wherein said first arms of said first and second members each have on a side thereof which faces said shelf a substantially planar surface, said surfaces being substantially coplanar when said members are in said use position; and wherein said first and second coupling means are concealed from view when said members are in said use position, said planar surfaces having adjacent edges which meet along a substantially straight line of engagement.

14. A shelving unit, comprising: a U-shaped frame having a pair of spaced, substantially parallel legs connected by a bight, said frame including first and second members having ends which are adjacent, each said leg of said frame being a portion of a respective one of said first and second members; coupling means provided on said adjacent ends of said first and second members integral therewith for releasably interconnecting said first and second members, said coupling means permitting relative pivotal movement of said members about a pivot axis within a range limited by a use position in which said legs are in said spaced, substantially parallel configuration and an assembly position in which said legs are nonparallel and the ends thereof remote from said bight are adjacent, wherein when said members are in said use position said coupling means releasably interconnects and prevents all relative movement of said members except pivotal movement about said pivot axis toward said assembly position, said first and second members being uncoupled from each other when in said assembly position; and a shelf and means for removably supporting said shelf between said legs when said members are in said use position so as to prevent movement of said legs toward each other and thus maintain said frame in said rigid, U-shaped configuration; wherein said coupling means includes said first and second members each having at said adjacent end thereof a generally V-shaped groove and a sector-shaped projection on a surface of said V-shaped groove, said surface of each said V-shaped groove having an outer edge which is substantially coincident with said pivot axis and each said sector-shaped projection having an axis which is substantially coincident with said pivot axis; wherein said coupling means further includes said first and second members each having at said adjacent ends thereof and spaced axially from said V-shaped groove therein a generally V-shaped projection and a sector-shaped recess in a surface of said V-shaped projection, said surface of each said V-shaped projection having an outer edge which is substantially coincident with said pivot axis and each said sector-shaped recess having an axis which is substantially coincident with said pivot axis, and wherein when said first and second members are in said use position, said V-shaped projection on each of said first and second members is received in said V-shaped groove in the other of said first and second members, said sector-shaped recess in each said V-shaped projection receiving said sector-shaped projection in the associated B-shaped groove.

* * * * *

UNITED STATES PATENT AND TRADEMARK OFFICE

CERTIFICATE OF CORRECTION

PATENT NO. : 4 463 684

DATED : August 7, 1984

INVENTOR(S) : Mark C. Klungle et al

It is certified that error appears in the above-identified patent and that said Letters Patent is hereby corrected as shown below:

Column 10, line 56; change "B-shaped" to ---V-shaped---.

Signed and Sealed this

*Fifth* Day of *March 1985*

[SEAL]

*Attest:*

DONALD J. QUIGG

*Attesting Officer* *Acting Commissioner of Patents and Trademarks*